US011535049B1

(12) United States Patent
Huang et al.

(10) Patent No.: US 11,535,049 B1
(45) Date of Patent: Dec. 27, 2022

(54) BOLT ACTION PEN WITH REFILL ADAPTER AND REVERSABLE POCKET CLIP

(71) Applicants: Zheng Huang, Chattanooga, TN (US); Chadwick Sterling Parker, Chattanooga, TN (US)

(72) Inventors: Zheng Huang, Chattanooga, TN (US); Chadwick Sterling Parker, Chattanooga, TN (US)

( * ) Notice: Subject to any disclaimer, the term of this patent is extended or adjusted under 35 U.S.C. 154(b) by 0 days.

(21) Appl. No.: 17/643,621

(22) Filed: Dec. 10, 2021

(51) Int. Cl.
*B43K 24/02* (2006.01)
*B43K 24/04* (2006.01)
*B43K 24/08* (2006.01)

(52) U.S. Cl.
CPC ..... *B43K 24/026* (2013.01); *B43K 24/04* (2013.01); *B43K 24/082* (2013.01)

(58) Field of Classification Search
CPC .... B43K 24/026; B43K 24/04; B43K 24/082; B43K 24/00; B43K 24/02; B43K 24/06; B43K 24/08
USPC ..... 401/109, 112, 116, 117
See application file for complete search history.

(56) References Cited

U.S. PATENT DOCUMENTS 3,804,536 A * 4/1974 Torii ..... B43K 21/20 401/65
7,350,996 B2 * 4/2008 Bielecki ..... B43K 8/24 401/110
10,836,203 B2 11/2020 Parker et al.
2018/0154680 A1 * 6/2018 Swanick ..... B43K 21/027

* cited by examiner

*Primary Examiner* — David J Walczak
(74) *Attorney, Agent, or Firm* — Squire Patent Consulting & IP Law LLC; Brendan E. Squire

(57) ABSTRACT

A bolt-action pen body is adapted as a universal receiver of an ink cartridge refill. The bolt action pen includes a hollow cylindrical pen body. A tip is removably coupled with an outer barrel at the distal end of the pen body. A refill cartridge is selectively extensible and retractable from the tip by a lever action movement of a bolt and a bolt carrier within a slot defined through a sidewall of the pen body. The bolt action pen provides for universal adjustment to various shapes of refill cartridges. An inner barrel is coupled with the pen body and is configured to adjust the pen body to a longitudinal length of the refill cartridge. A collet carried within the tip is configured for compressive adjustment to a diameter of writing end of the refill cartridge.

9 Claims, 3 Drawing Sheets

BOLT ACTION PEN WITH REFILL ADAPTER AND REVERSABLE POCKET CLIP

BACKGROUND OF THE INVENTION

The present invention relates to pen bodies, and more particularly to pen bodies with cartridge refills.

Pen bodies will typically contain an ink cartridge that may be replaced when the supply of ink carried therein is depleted, have dried out, or the ink cartridge is otherwise incapable of writing. Most pen bodies require a specific cartridge type when replacement of the cartridge is required. Finding the specific cartridge type is often difficult and requires either the original ink cartridge for matching with the replacement or testing the refill cartridge with the pen body for proper fit and function. Few pens offer adaptation of the pen body for a universal reception of the ink cartridge refill.

Various bolt action pens are available. These bolt action pens suffer from the same deficiency as most pen bodies in that they require a specific ink cartridge refill.

As can be seen, there is a need for improved bolt action pen body that is adapted to receive an ink cartridge refill, regardless of the dimensions of the ink cartridge refill.

SUMMARY OF THE INVENTION

In one aspect of the present invention, a bolt action pen for universal reception of a refill cartridge is disclosed. The bolt action pen includes a pen body having a proximal end, a distal end, an inner surface, an outer surface, an interior cavity, and a first thread on the inner surface extending inwardly from the distal end. A bolt and a bolt carrier are configured to selectively advance and retract the refill cartridge between a writing position and a stowed position via a slot extending through the proximal end of the pen body. An inner barrel is dimensioned to adjustably receive a reservoir end of the refill cartridge. The inner barrel has an adjustment thread at a proximal end that is received with the first thread of the pen body, and a threaded shoulder region at a distal end. An outer barrel has an inner bore and a second thread defined in a distal end of the inner bore. The second thread is configured to couple with a proximal end of the threaded shoulder region. A tip is carried on a distal end of the threaded shoulder region. A collet is carried within the tip. The collet is configured for compressive adjustment to a writing end of the refill cartridge.

In some embodiments, a pocket clip is reversibly retained on the proximal end of the pen body via a retaining cap. An annular rim protrudes from an inner face of the retaining cap. A pair of notches are defined in the annular rim at a radially offset orientation. Each of the pair of notches are dimensioned to receive the pocket clip.

In some embodiments, a receiver is dimensioned to be received within a proximal end of the pen body. A fastener extends through the retaining cap, such that tightening of the fastener urges the receiver in abutment with the inner surface of the pen body.

In some embodiments, one or more O-rings are carried on a distal end of the pen body. The one or more O-rings provide a rotational frictional interference between the pen body and the inner bore of the outer barrel.

In some embodiments, a tension spring is received on a writing tip of the refill cartridge to bias the refill cartridge toward the stowed position.

In other aspects of the invention, a bolt action pen for universal reception of a refill cartridge is disclosed. The bolt action pen includes a pen body having a proximal end, a distal end, an interior cavity. An inner barrel is rotationally coupled with the pen body and configured to adjust a longitudinal length of the pen body to a longitudinal length of the refill cartridge. A bolt and a bolt carrier are configured to selectively advance and retract the refill cartridge between a writing position and a stowed position via a slot extending through the proximal end of the pen body. A tip is coupled with a distal end of the inner barrel. A collet is carried within the tip and is configured for compressive adjustment to a diameter of writing end of the refill cartridge.

In some embodiments, an outer barrel is operatively coupled with the inner barrel. The outer barrel is configured to adjustably carry the tip with a longitudinal adjustment of the pen body.

In some embodiments, an adjustment thread at a proximal end of the inner barrel is cooperatively received with a first thread defined on an interior surface of the pen body. A threaded shoulder region is provided at a distal end of the inner barrel. A second thread is defined in a distal end of the outer barrel. The second thread is configured to couple with a proximal end of the threaded shoulder region. A plurality of threads are defined within an inner surface of the tip and are configured to couple with a distal end of the threaded shoulder region.

In some embodiments, one or more O-rings are interposed between the pen body and the outer barrel. The one or more O-rings provide a rotational frictional resistance between the pen body and the outer barrel.

These and other features, aspects and advantages of the present invention will become better understood with reference to the following drawings, description and claims.

DETAILED DESCRIPTION

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims.

Broadly, embodiments of the present invention provide a bolt-action pen body that is adapted to universally receive an ink cartridge refill, regardless of the dimensions of the ink cartridge refill.

Figure 1:
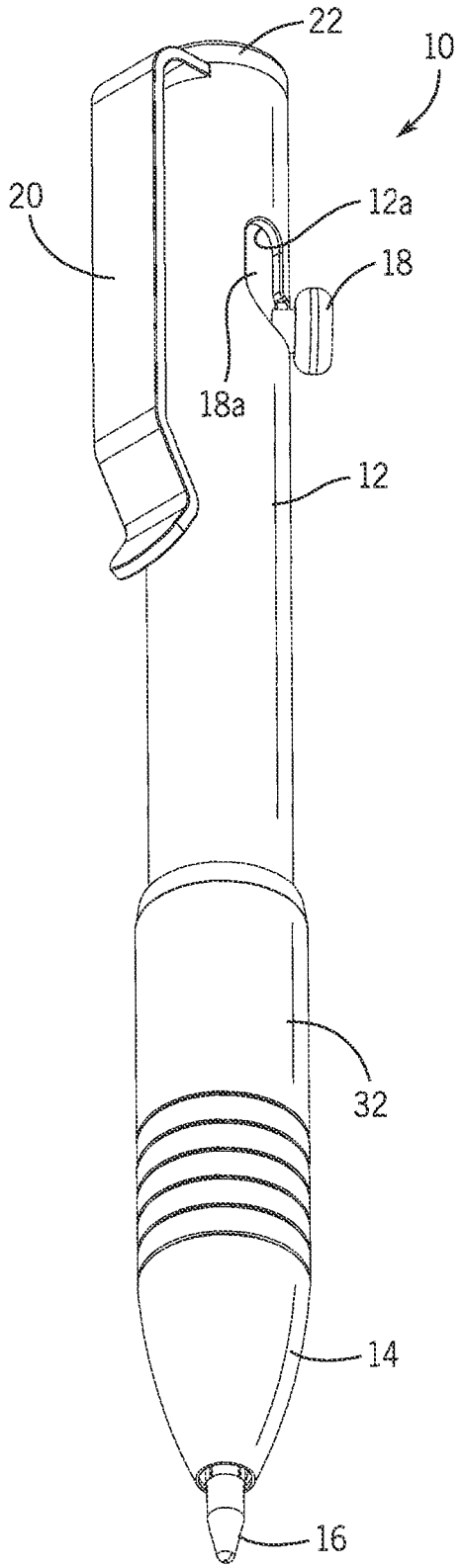
FIG. 1 is a perspective view of the first embodiment of the invention.
Figure 2:
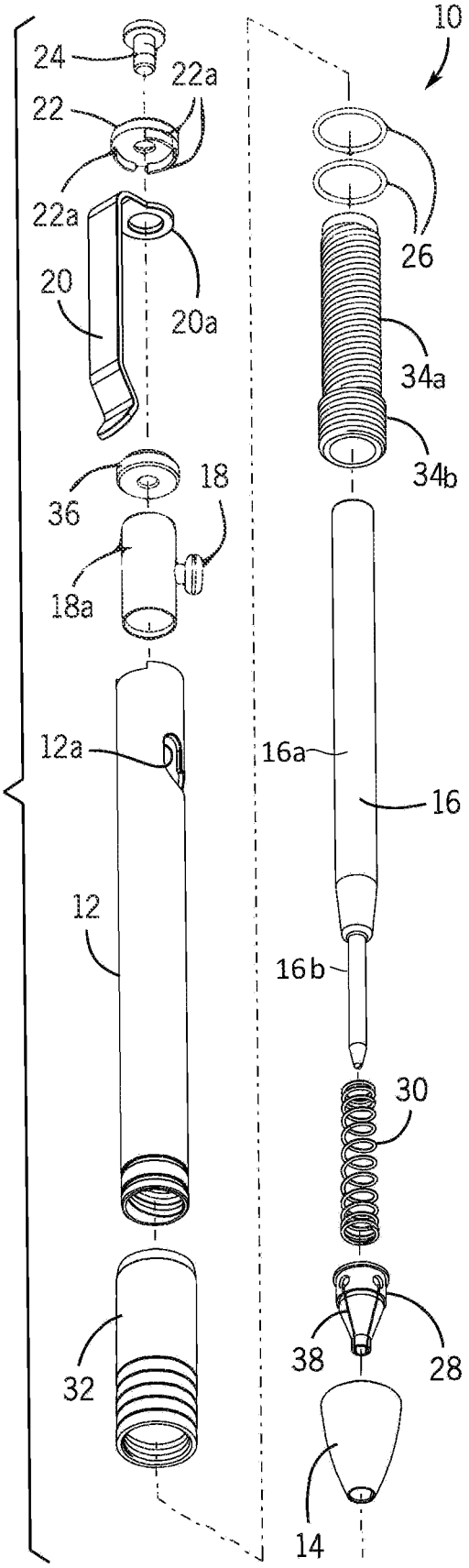
FIG. 2 is an exploded perspective view of the first embodiment of the invention.
Figure 3:
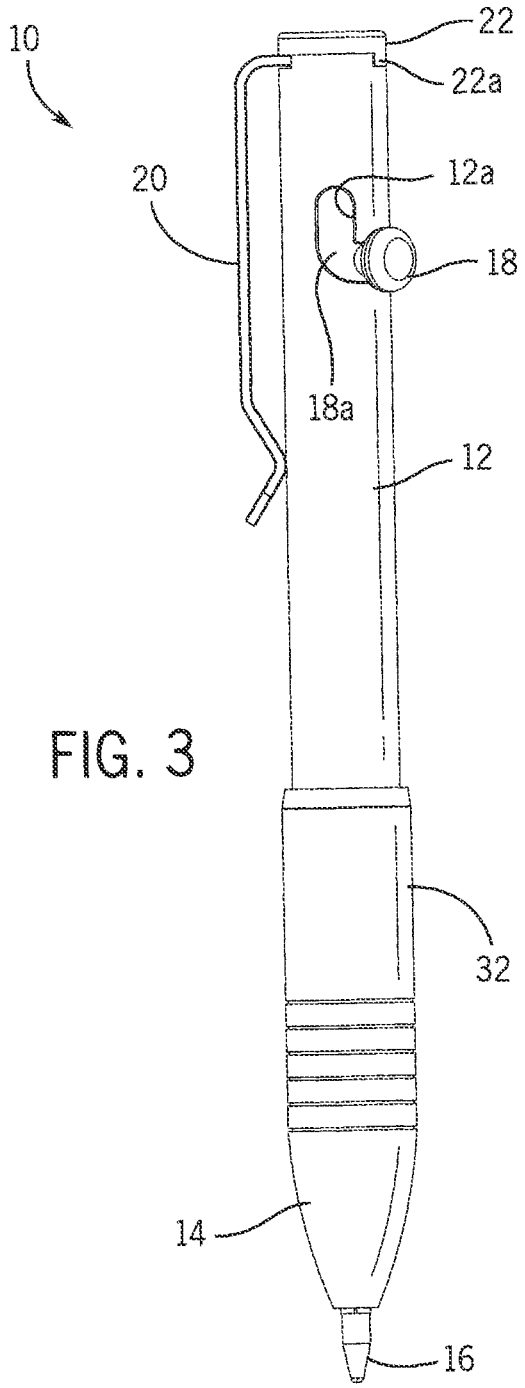
FIG. 3 is a side elevation view of the of the first embodiment of the invention showing the pocket clip in the first position.
Figure 4:
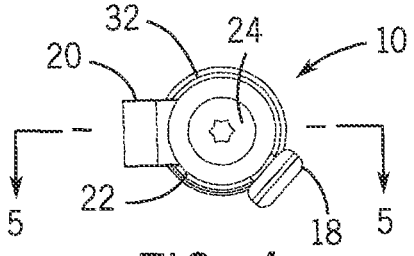
FIG. 4 is a top plan view of the first embodiment of the invention showing the pocket clip in the first position.
Figure 5:
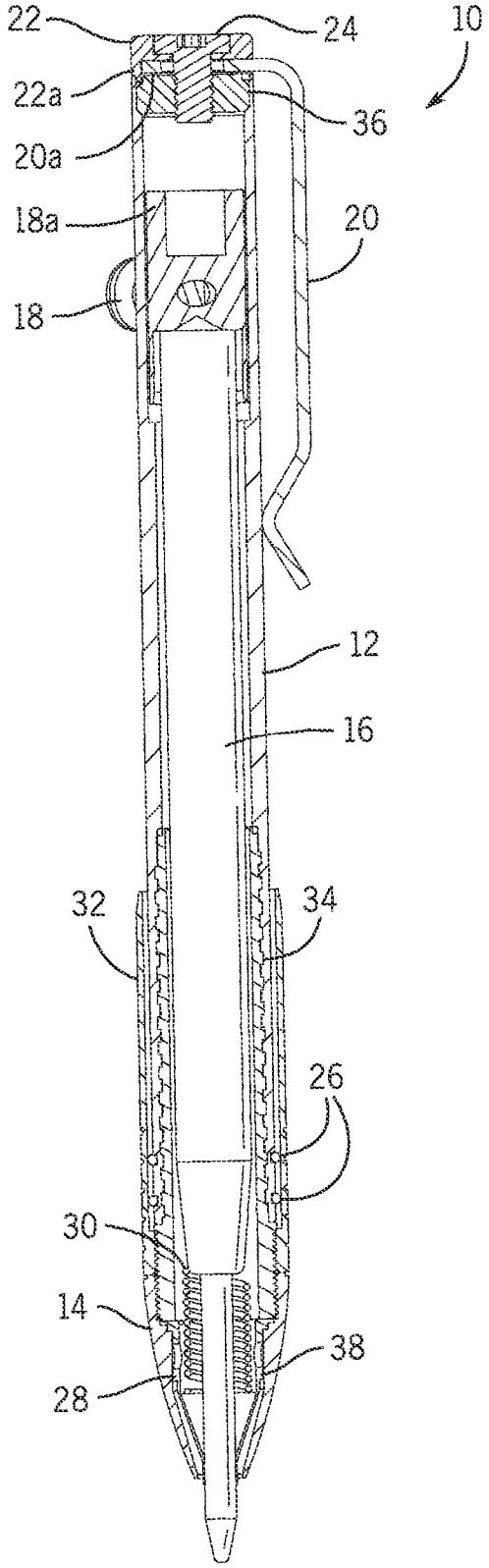
FIG. 5 is a section view taken along line 5-5 of FIG. 4.
Figure 6:
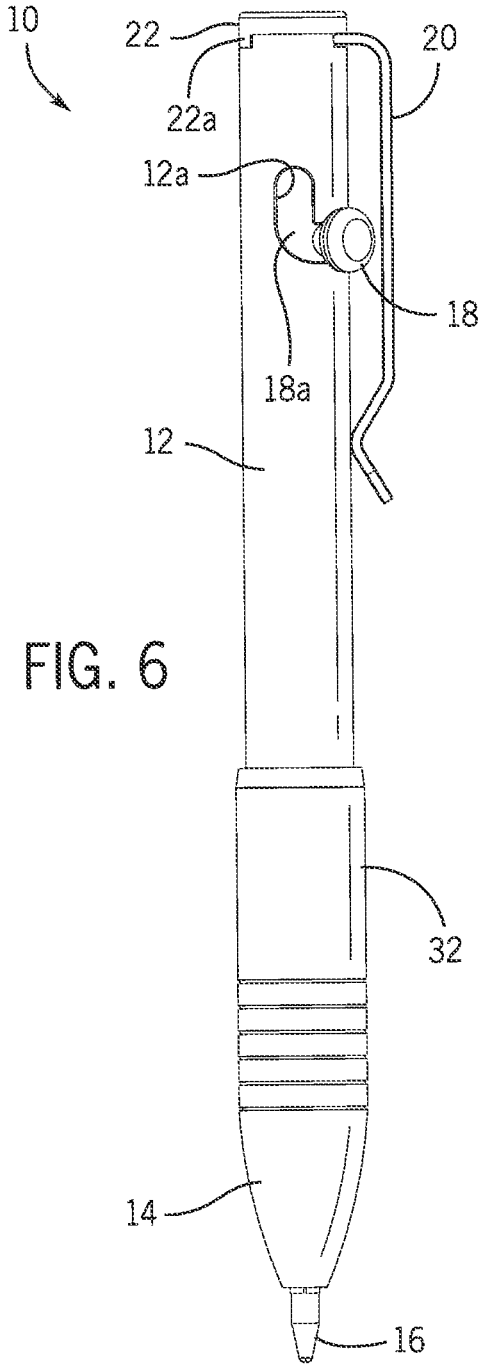
FIG. 6 is a side elevation view of the first embodiment of the invention showing the pocket clip in the second position.
Figure 8:
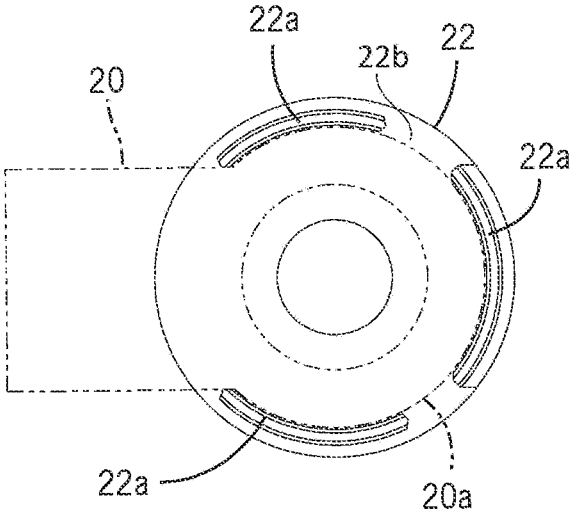
FIG. 8 is a bottom plan view of the end cap of the first embodiment with the pocket clip shown in phantom lines.
Figure 9:
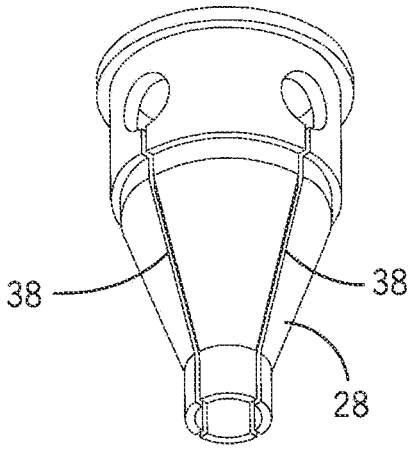
FIG. 9 is a perspective view of the collet of the first embodiment of the invention.
Figure 7:
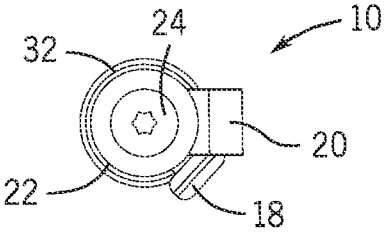
FIG. 7 is a top plan view of the first embodiment of the invention showing the pocket clip in the second position.

As seen in reference to FIGS. 1-9, the bolt action pen 10 includes a hollow cylindrical pen body 12 having a proximal end, a distal end, and an interior cavity. A tip 14 is removably coupled with an outer barrel 32 at the distal end of the pen body 12. A refill cartridge 16 is carried within the pen body 12. The refill cartridge 16 is selectively extensible and retractable from the tip 14 by a lever action movement of a bolt 18 and a bolt carrier 18*a* within a slot 12*a* defined through a sidewall of the proximal end of the pen body 12. The bolt carrier 18*a* has a cylindrical opening at a distal end dimensioned to receive a proximal end of a refill cartridge 16. Operation of the bolt 18 and bolt carrier 18*a* within the slot 12*a* selectively advances and retracts the bolt carrier 18*a* within the pen body 12 for movement of the refill cartridge 16 between a writing position and a stowed position. Aspects of the invention provide for accommodation of the bolt action pen 10 for universal adjustment to various shapes of refill cartridges 16.

A pocket clip 20 is retained on the proximal end of the pen body 12 by a retaining cap 22 extending through a ring opening 20*a* at a proximal end of the pocket clip 20. The pocket clip 20 is reversible relative to bolt 18 and bolt carrier 18*a* of the pen body 12. The retaining cap 22 has an annular rim 22*a* protruding from an inner face of the retaining cap 22. A pair of notches 22*b* are defined in the annular rim at radially offset positions for positioning of the pocket clip 20. A fastener 24 connects the pocket clip 20 and retaining cap 22 with an insert 36 received within the proximal end of the pen body 12. The insert 36 compresses with an inner sidewall of the pen body 12 when the fastener 24 is tightened. Preferably, the fastener 24 mimics a primer received in end of a shell cartridge with the retaining cap dimensioned to mimic the end of the shell cartridge.

A universal refill cartridge adjustment mechanism is carried within the pen body 12 and the outer barrel 32. As best seen in reference to FIGS. 2 and 5, the universal refill cartridge adjustment mechanism includes one or more O-rings 26, the outer barrel 32, an inner barrel 34, a collet 28, and a tension spring 30. The universal refill cartridge adjustment mechanism adapts the pen body 12 to receive refill cartridges 16 having variously sized ink reservoirs 16*a* and writing ends 16*b*. The one or more O-rings 26 are fitted to the distal end of the pen body 12 and provide a frictional resistance between the pen body 12 and the outer barrel 32.

The proximal end of the inner barrel 34 has adjustment threads 34*a* extending along the length of the inner barrel 34. The adjustment threads 34*a* cooperatively engage with a first threaded region defined in the interior sidewall along the distal end of the pen body 12. The adjustment threads 34*a* adjust a longitudinal length of the pen body 12 to accommodate for varying lengths of refill cartridges 16.

The distal end of the inner barrel 34 has a threaded shoulder region 34*b*. The threaded shoulder region 34*b* cooperatively engage with a plurality of threads within the tip 14 and a second threaded region defined in the interior sidewall of the outer barrel 32, at a distal end thereof, such that the tip 14 is retained in abutment with the distal end of the outer barrel 32. A majority of the interior surface of the outer barrel 32 has a smooth surface such that engages with the O-rings 26 as the length of the pen is adjusted to accommodate the refill cartridge 16.

A collet 28 is compressible along a plurality of tension cuts 38 radially disposed about the collet 28 and extending from a tip of the collet 28 to a base of the collet 28. The collet 28 is dimensioned to be received within the tip 14. An annular lip extends around a periphery of the base of the collet 28 and is received within an annular ledge defined around the interior of the tip 14 distal from the plurality of threads within the tip 14. The threaded engagement of the tip 14 with the shoulder region 34*b* urges the base of the collet 28 against the distal end of the inner barrel 34 while compressing the collet 28 along the plurality of tension cuts 38 to retain a narrow writing end 16*a* of the refill cartridge 16.

In operation, the adjustment threads 34*a* are engaged with the first threaded region of the pen body 12. The second threaded region of the outer barrel 32 is then coupled with the threaded shoulder region 34*b* of the inner barrel 34. The cartridge end 16*a* of the pen refill 16 is inserted into the inner barrel 34 until it is received within the cylindrical opening of the bolt carrier 18*a*. The tension spring 30 is then applied to the narrow writing end 16*b* of the refill cartridge 16 and the collet 28 is applied to the narrow writing end 16*b* to contain the tension spring 30 therein. The tip 14 is then coupled with the shouldered region 34*b*.

To adjust the length of the pen body 12 to the refill cartridge 16, the bolt 18 and bolt carrier 18*a* are moved to the advanced position. The tip 14 should be loosened on the shouldered region 34*b* to relieve tension in the collet 28 about the narrow writing end 16*b* of the refill cartridge 16. The outer barrel 32 is then rotated to selectively advance or retract the inner barrel 34 within the pen body 12 until the proximal end of the refill cartridge 16 is in abutment with the cylindrical opening of the bolt carrier 18*a* and the narrow writing end 16*b* extends from the tip 14 by a desired writing distance. The tip 14 is then tightened to compress the collet about the narrow writing tip 16*b*. Actuation of the bolt 18 and bolt carrier 18*b* within slot 12*a* may then retract the refill cartridge 16 to the stowed position by pressure applied by the tension spring 30.

It should be understood, of course, that the foregoing relates to exemplary embodiments of the invention and that modifications may be made without departing from the spirit and scope of the invention as set forth in the following claims.

What is claimed is:

1. A bolt action pen for universal reception of a refill cartridge, comprising:

a pen body having a proximal end, a distal end, an inner surface, an outer surface, an interior cavity, and a first thread on the inner surface extending inwardly from the distal end;

a bolt and a bolt carrier, configured to selectively advance and retract the refill cartridge between a writing position and a stowed position, via a slot extending through the proximal end of the pen body;

an inner barrel dimensioned to adjustably receive a reservoir end of the refill cartridge, the inner barrel having an adjustment thread at a proximal end received with the first thread of the pen body, and a threaded shoulder region at a distal end;

an outer barrel having an inner bore and a second thread defined in a distal end of the inner bore, the second thread configured to couple with a proximal end of the threaded shoulder region;

a tip carried on a distal end of the threaded shoulder region;

and a collet carried within the tip, the collet configured for compressive adjustment to a writing end of the refill cartridge.

2. The bolt action pen of claim 1, further comprising:

a pocket clip reversibly retained on the proximal end of the pen body via a retaining cap.

3. The bolt action pen of claim 2, further comprising:

an annular rim protruding from an inner face of the retaining cap;

and a pair of notches defined in the annular rim at a radially offset orientation, each of the pair of notches dimensioned to receive the pocket clip.

4. The bolt action pen of claim 3, further comprising:

an insert dimensioned to be received within a proximal end of the pen body;

and a fastener extending through the retaining cap, wherein tightening of the fastener urges the insert in abutment with the inner surface of the pen body.

5. The bolt action pen of claim 1, further comprising:

one or more O-rings carried on a distal end of the pen body, the one or more O-rings providing a rotational frictional interference between the pen body and the inner bore of the outer barrel.

6. The bolt action pen of claim 1, further comprising:

a tension spring received on a writing tip of the refill cartridge to bias the refill cartridge toward the stowed position.

7. A bolt action pen for universal reception of a refill cartridge, comprising:

a pen body having a proximal end, a distal end, an interior cavity;

an inner barrel coupled with the pen body and configured to adjust a longitudinal length of the pen body to a longitudinal length of the refill cartridge, a bolt, and a bolt carrier, configured to selectively advance and retract the refill cartridge between a writing position and a stowed position, via a slot extending through the proximal end of the pen body;

a tip coupled with a distal end of the inner barrel;

an outer barrel operatively coupled with the inner barrel, the outer barrel configured to adjustably carry the tip with a longitudinal adjustment of the pen body; and a collet carried within the tip, the collet configured for compressive adjustment to a diameter of writing end of the refill cartridge.

8. The bolt action pen of claim 7, further comprising:

an adjustment thread at a proximal end of the inner barrel cooperatively received with a first thread defined on an interior surface of the pen body, and a threaded shoulder region at a distal end of the inner barrel;

a second thread defined in a distal end of the outer barrel, the second thread configured to couple with a proximal end of the threaded shoulder region; and a plurality of threads defined within an inner surface of the tip, the plurality of threads configured to couple with a distal end of the threaded shoulder region.

9. The bolt action pen of claim 8, further comprising:

one or more O-rings interposed between the pen body and the outer barrel, the one or more O-rings providing a rotational frictional resistance between the pen body and the outer barrel.

* * * * *